US011913245B2

(12) United States Patent
Yakubov

(10) Patent No.: US 11,913,245 B2
(45) Date of Patent: Feb. 27, 2024

(54) INFLATABLE AIR MATTRESS TENT ASSEMBLY

(71) Applicant: Valery Yakubov, Winterhaven, FL (US)

(72) Inventor: Valery Yakubov, Winterhaven, FL (US)

( * ) Notice: Subject to any disclaimer, the term of this patent is extended or adjusted under 35 U.S.C. 154(b) by 159 days.

(21) Appl. No.: 17/709,671

(22) Filed: Mar. 31, 2022

(65) Prior Publication Data

US 2022/0268050 A1 Aug. 25, 2022

Related U.S. Application Data

(60) Provisional application No. 63/177,796, filed on Apr. 21, 2021.

(51) Int. Cl.
*E04H 15/32* (2006.01)
*A47C 27/08* (2006.01)

(52) U.S. Cl.
CPC ..... *E04H 15/324* (2013.01); *A47C 27/082* (2013.01)

(58) Field of Classification Search
CPC . E04H 15/324; E04H 2015/208; E04H 15/20; A47C 27/082
See application file for complete search history.

(56) References Cited

U.S. PATENT DOCUMENTS 2,754,836 A * 7/1956 William ..... E04H 15/20 52/2.21
4,819,389 A * 4/1989 Kihn ..... E04H 15/20 52/2.21
5,247,768 A * 9/1993 Russo ..... E04H 15/20 52/2.13
5,636,478 A * 6/1997 Chen ..... E04H 15/324 135/96
5,913,322 A * 6/1999 Gallant ..... E04H 15/42 D21/834
6,167,898 B1 * 1/2001 Larga ..... E04H 15/20 135/124
8,776,812 B1 * 7/2014 Forget ..... E04H 15/56 135/96
9,624,688 B1 * 4/2017 Tyson ..... E04H 15/06
10,801,231 B1 * 10/2020 Ensign ..... E04H 15/12
2003/0213512 A1 * 11/2003 Lee ..... E04H 15/20 135/126

FOREIGN PATENT DOCUMENTS

WO WO-2012094769 A1 * 7/2012 ..... A47G 9/086

* cited by examiner

*Primary Examiner* — Noah Chandler Hawk

(57) ABSTRACT

An inflatable air mattress tent assembly for integrating an air pump within the tent includes a tent. The tent has a pair of sides and a pair of walls. The tent has an interior that defines a space for a mattress to be positioned within. The mattress can be inflated by air from a pump that the mattress is in fluid communication with. The pump is attached to the tent and the pump provides air to inflate the mattress and a pillow. The pillow is positioned on a surface of the mattress and has a conduit. The conduit makes the pillow be in fluid communication with the mattress.

10 Claims, 6 Drawing Sheets

INFLATABLE AIR MATTRESS TENT ASSEMBLY

CROSS-REFERENCE TO RELATED APPLICATIONS

I hereby claim the benefit under 35 U.S.C. Section 119(e) of U.S. Provisional application Ser. No. 63/177,796 Filed Apr. 21, 2021.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to inflatable mattresses and tent devices and more particularly pertains to a new inflatable mattress and tent device for integrating an air pump within the tent.

(2) Description of Related Art Including Information Disclosed Under 37 CFR 1.97 and 1.98

The prior art relates to inflatable mattresses and tent devices. Known prior art relates to inflatable mattresses and tent devices having an inflatable mattress configured for use in a variety of tents. Known prior art lacks an inflatable mattress and tent device having an integrated air pump whereby providing inflation to an inflatable mattress in a fixed positioned within the tent.

BRIEF SUMMARY OF THE INVENTION

An embodiment of the disclosure meets the needs presented above by generally comprising a tent. The tent has a pair of sides and a pair of walls. Furthermore, the tent has an interior that defines a space for a variety of elements to be positioned within. A mattress is positioned within the interior of the tent. The mattress is configured for inflation by air and is in fluid communication with a pump. The pump is configured for providing air to inflate the mattress. A pillow is positioned on a surface of the mattress. The pillow has a conduit being in fluid communication with the mattress, whereby the pillow is configured for inflation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
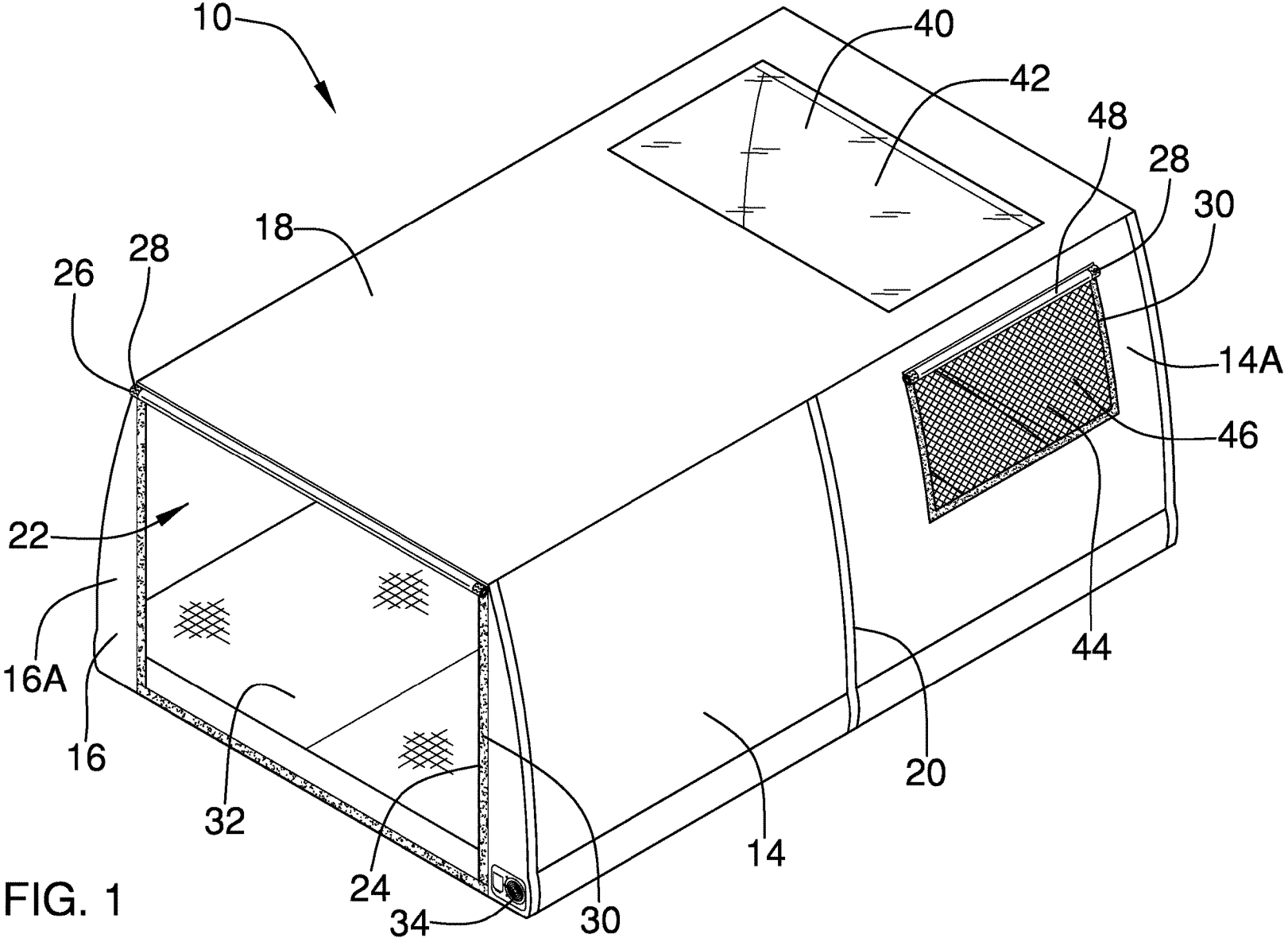
FIG. 1 is a front isometric view of an inflatable air mattress tent assembly according to an embodiment of the disclosure.

With reference now to the drawings, and in particular to FIGS. 1 through 6 thereof, a new inflatable mattress and tent device embodying the principles and concepts of an embodiment of the disclosure and generally designated by the reference numeral 10 will be described.

As best illustrated in FIGS. 1 through 6, the inflatable air mattress tent assembly 10 generally comprises a tent 12. The tent 12 has a pair of sides 14 and a pair of walls 16. The pair of sides 14 is positioned perpendicular relative to the pair of walls 16. A roof 18 is positioned above the pair of sides 14 and the pair of walls 16. Additionally, the roof 18 is positioned perpendicular relative to the pair of sides 14 and the pair of walls 16. A plurality of supports 20 is positioned on each of the sides 14. Each of the supports 20 is a rectangular bar configured for providing stability and support to each of the sides 14. The pair of sides 14 and the pair of walls 16 create a rectangular prism shape of the tent 12. The roof 18 has a plurality of cables 19 coupled to the plurality of supports 20. The plurality of cables 19 is configured for providing structure to the roof 18. The tent 12 has an interior 22 that defines a space for a variety of elements to be positioned within.

A door 24 is positioned on a first wall 16A of the pair of walls 16 as shown in FIG. 1. The door 24 provides an opening to the interior 22 of the tent 12. The door 24 has a flap 26 that has hook material 28. Additionally, the door 24 has a loop material 30 that is complementary to the hook material 28 of the flap 26. The flap 26 is configured for engaging by hook and loop fastening to the door 24. The flap 26 can be enwrapped within itself when the door 24 is in an open position.

Figure 2:
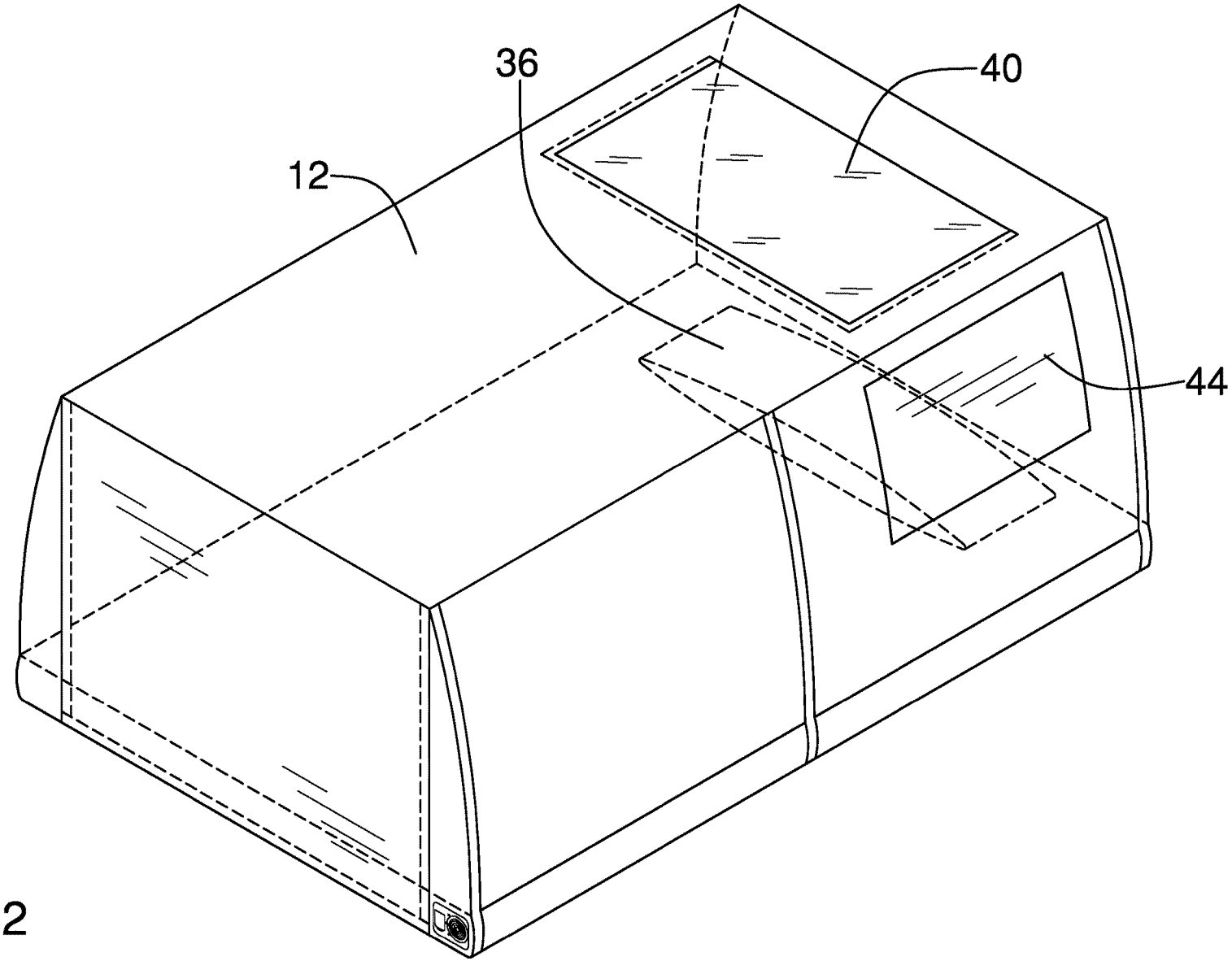
FIG. 2 is a front isometric view of an embodiment of the disclosure.
Figure 3:
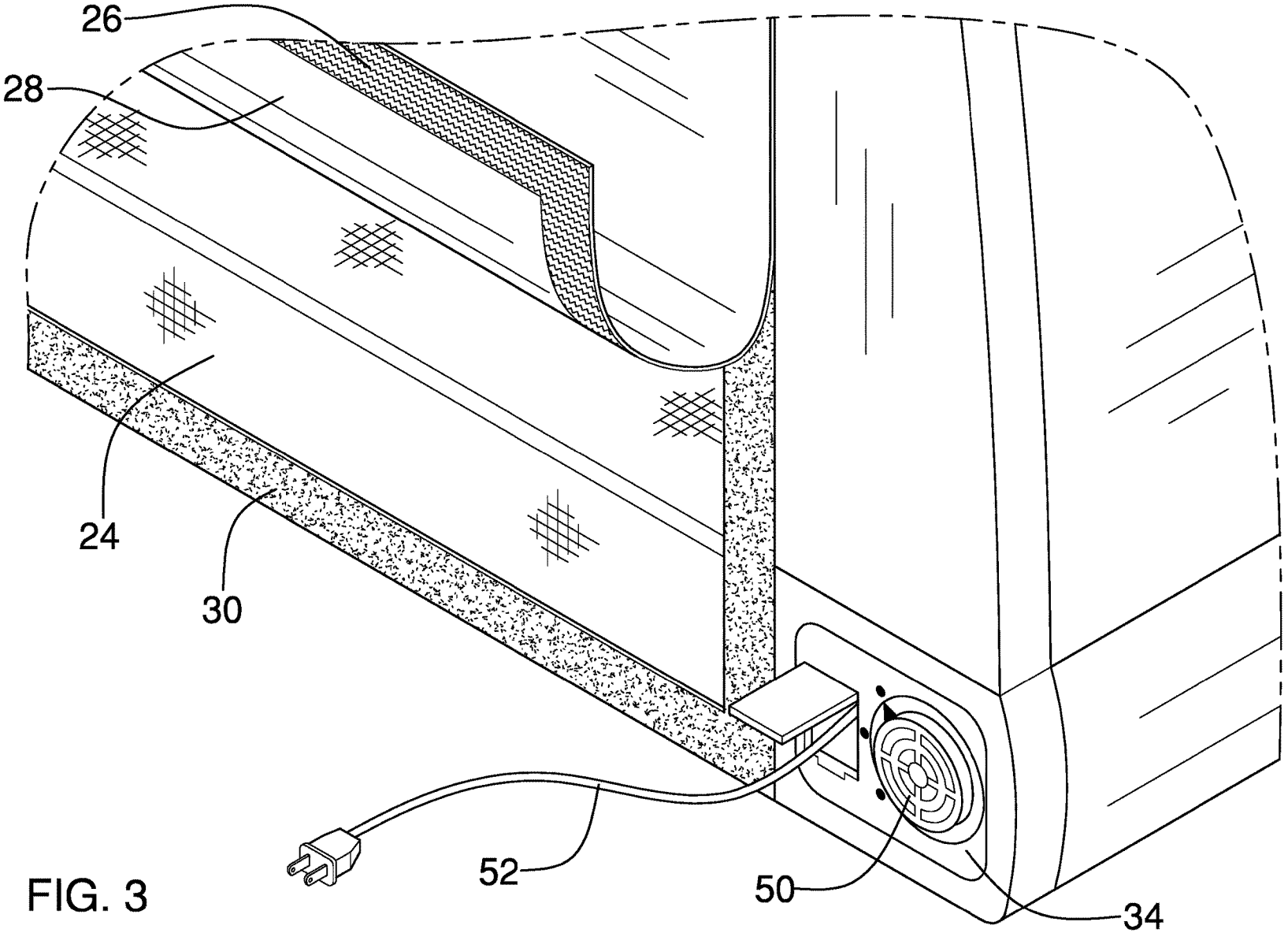
FIG. 3 is a detail isometric view of an embodiment of the disclosure.
Figure 4:
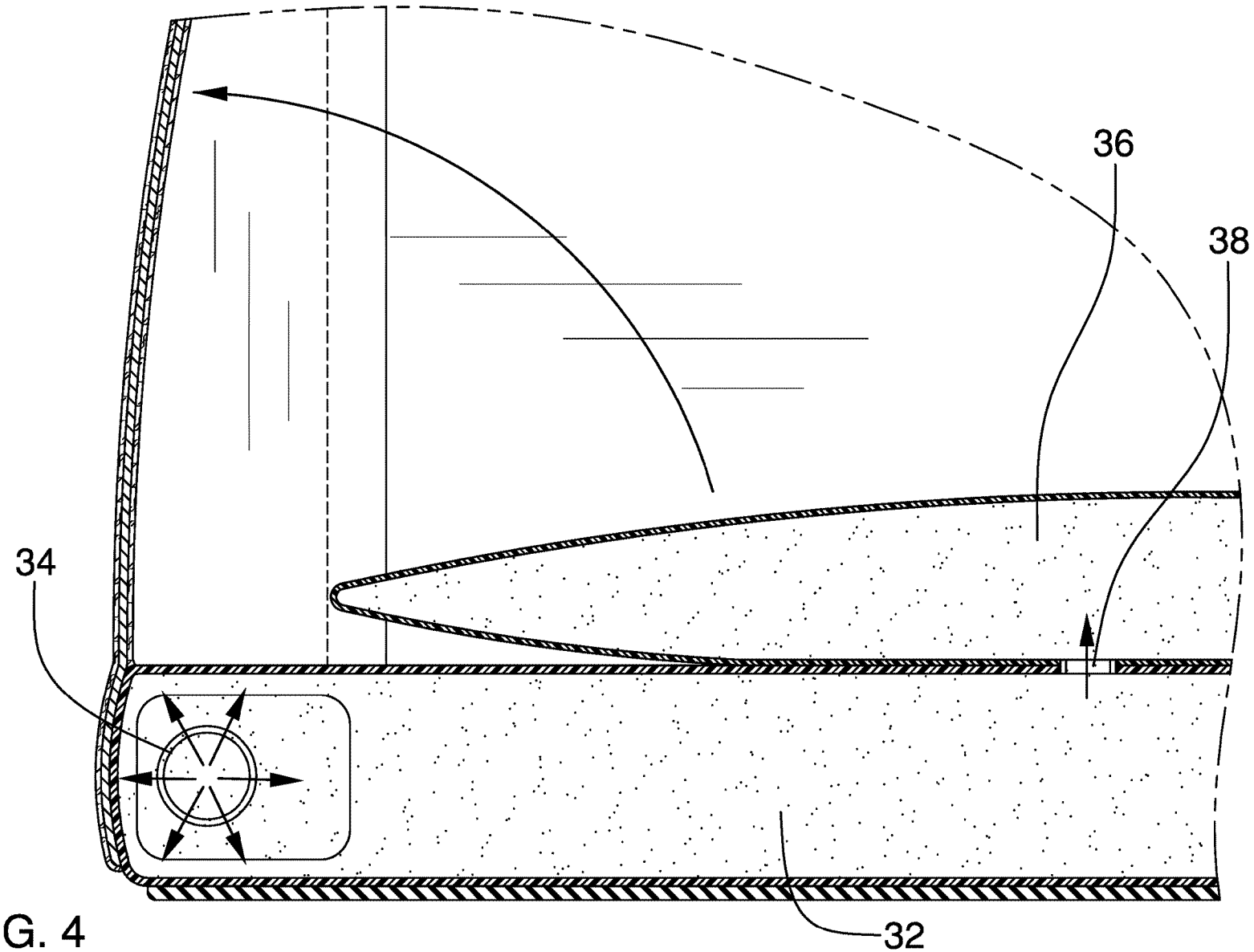
FIG. 4 is a cross-sectional view of an embodiment of the disclosure.
Figure 5:
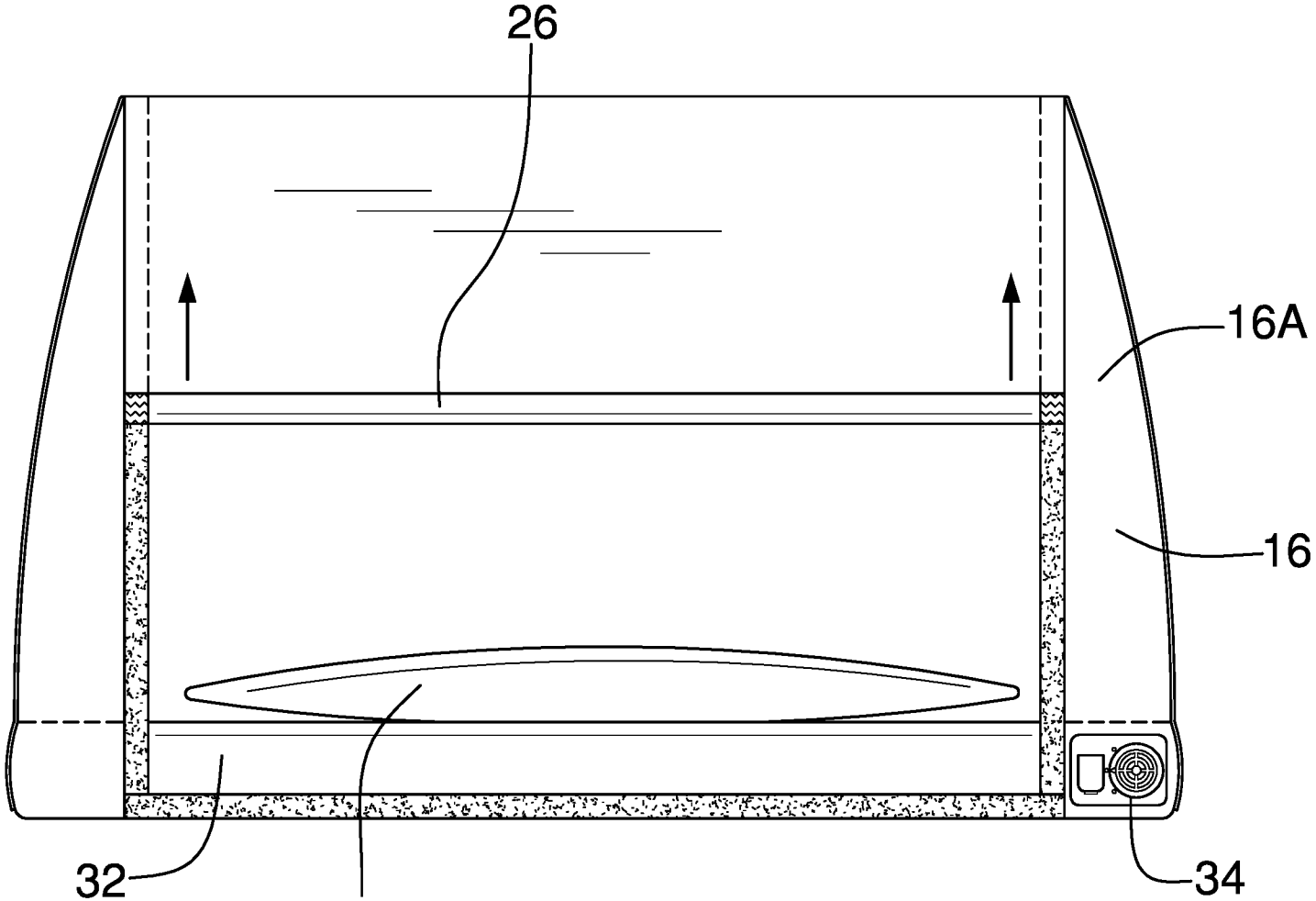
FIG. 5 is a front view of an embodiment of the disclosure.
Figure 6:
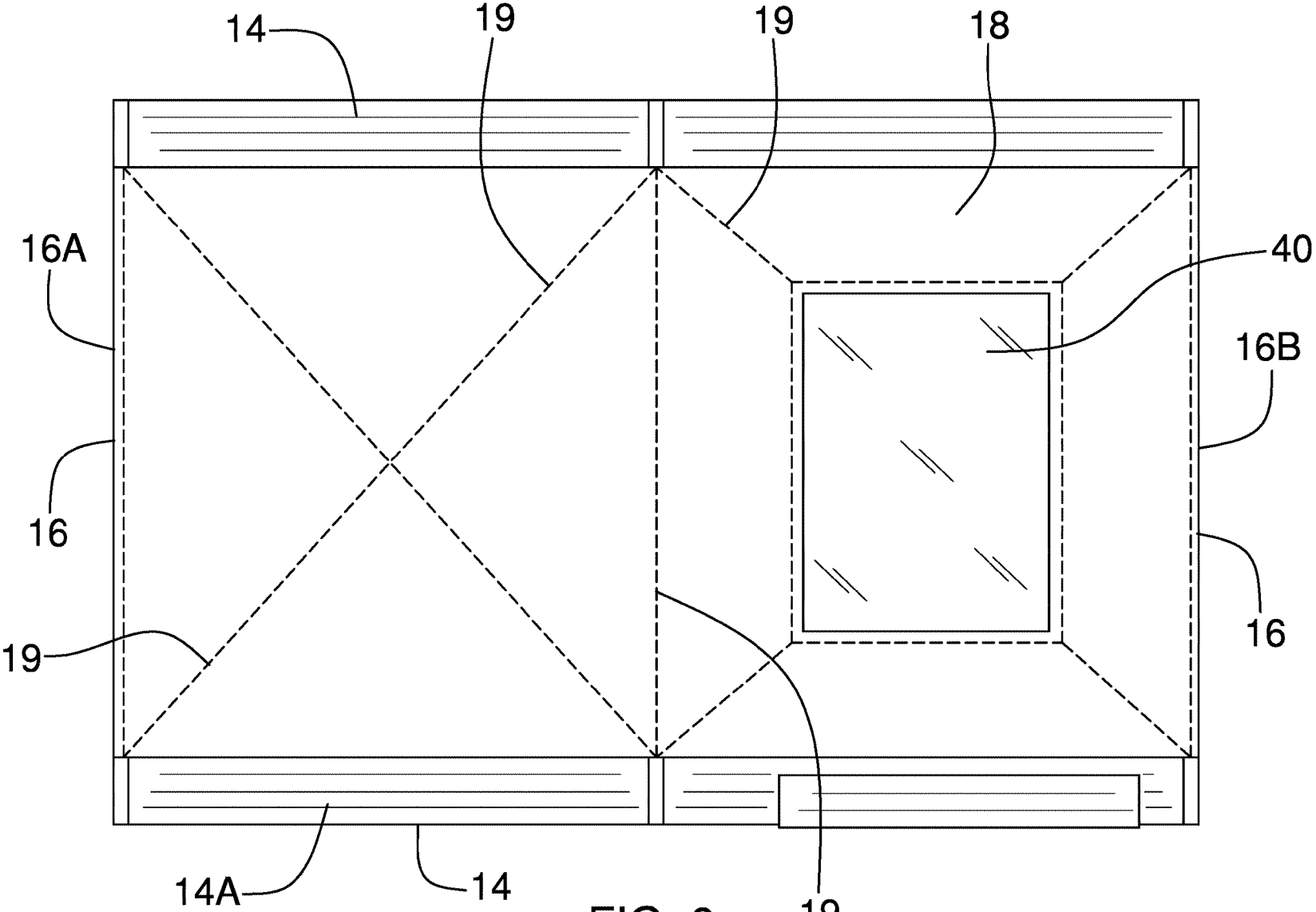
FIG. 6 is a top view of an embodiment of the disclosure.

A mattress 32 is positioned within the interior 22 of the tent 12. The mattress 32 is an air mattress and is configured for inflation by air. The mattress 32 is in fluid communication with a pump 34. The pump 34 is an air pump and is positioned on the first wall 16A of the pair of walls 16. The pump 34 is integrated within the tent 12, whereby retaining the mattress 32 in a fixed positioned within the interior 22 of the tent 12. The pump 34 is configured for providing air to inflate the mattress 32 when the pump 34 is turned on. The pump 34 can be turned on or off using an actuator 50. The actuator 50 has a dial used to turn the pump 34 on or off. The pump 34 has an outlet plug 52 to provide power to the pump 34. When the mattress 32 is inflated, the plurality of supports 20 of each of the sides 14 moves to a perpendicular position relative to the mattress 32 whereby positioning the tent 12 in an open position. Subsequently, the pair of walls 16 also position in a perpendicular position relative to the mattress 32, and the roof 18 becomes parallel relative to the mattress 32 as shown in FIG. 2.

A pillow 36 is positioned on a surface of the mattress 32 proximate to a second wall 16B of the pair of walls 16. The pillow 36 has a conduit 38 being in fluid communication with the mattress 32. The pillow 36 is configured for inflation along with the mattress 32 when the pump 34 is providing air. The pillow 36 provides an area for the user to position their head when lying down. Positioned above the pillow 36 is a window 40. The window 40 is positioned on the roof 18 of the tent 12. The window 40 is transparent and is made of a plastic material 42. The plastic material 42 makes the window 40 resistant to breaking from environmental influences such as rain or hail. The transparency of the window 40 allows the user to see clearly through the window 40.

A screen 44 in positioned on a first side 14A of the pair of sides 14. The screen 44 is made of a net material 46 which has a plurality of interwoven rope in cross patterns. The net material 46 provides a reduced transparency relative to the window 40, such that the screen provides some privacy for the interior 22 of the tent 12. The screen 44 has a flap 48 with the hook material 28, whereby the screen 44 has the loop material 30. The flap 48 is configured for engaging by hook and loop fastening to the screen 44.

In use, the pump 34 of the tent 12 is turned on to begin inflating the mattress 32. As the mattress 32 begins to inflate, the pillow 36 positioned on the mattress 32 inflates as well. Subsequently, the plurality of supports 20 begins to move the pair of sides 14 to an upright position relative to the mattress 32 as the inflation of the mattress 32 continues. The plurality of supports 20 holds the roof 18 of the tent 12 above both the pair of sides 14 and the pair of walls 16, thus defining the interior 22 of the tent 12. When the mattress 32 is entirely inflated, the pump 34 can be turned off and the air will remain in the mattress 32. The flap 26 to the door 24 can be enwrapped within it self to provide access to the interior 22 of the tent 12. Furthermore, the flap 48 of the screen 44 can be enwrapped within itself to provide access to the screen 44. The tent 12 is configured for to be used in camping.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An inflatable air mattress tent assembly comprising:

a tent having a pair of sides, the tent having a pair of walls, the tent having an interior, the interior defining a space for a variety of elements to be positioned within, each of the sides having a plurality of supports, the plurality of supports being rectangular bars configured for providing stability to each of the sides;

a mattress being positioned within the interior of the tent, the mattress being configured for inflation by air, the mattress being in fluid communication with a pump, the pump being configured for providing air to inflate the mattress;

a pillow being positioned on a surface of the mattress, the pillow having a conduit, the conduit being in fluid communication with the mattress, the pillow being configured for inflation; and a roof being positioned perpendicular relative to the pair of sides and the pair of walls, the roof having a plurality of cables, the cables being coupled to the plurality of supports, each of the cables being configured for providing structure to the roof.

2. The inflatable air mattress tent assembly of claim 1, further comprising the pair of sides being positioned perpendicular relative to the pair of walls.

3. The inflatable air mattress tent assembly of claim 1, further comprising a door being positioned on a first wall of the pair of walls, the door having a flap, the flap having hook material, the door having loop material, the flap engaging by hook and loop fastening to the door.

4. The inflatable air mattress tent assembly of claim 3, further comprising the pump being positioned on the first wall of the pair of walls.

5. The inflatable air mattress tent assembly of claim 3, further comprising the pillow being positioned proximate to a second wall of the pair of walls.

6. The inflatable air mattress tent assembly of claim 3, further comprising a screen, the screen being positioned on a first side of the pair of sides, the screen being a net material, the net material having a plurality of interwoven rope, the screen having a flap, the flap having the hook material, the screen having the loop material, the flap being configured for engaging by hook and loop fastening to the screen.

7. The inflatable air mattress tent assembly of claim 1, further comprising the mattress being an air mattress.

8. The inflatable air mattress tent assembly of claim 1, further comprising the mattress being configured for positioning the plurality of supports in a vertical position whereby positioning the pair of sides and the pair of walls in an upright position.

9. The inflatable air mattress tent assembly of claim 1, further comprising a window, the window being positioned on the roof of the tent, the window being transparent, the window being a plastic material, the window being configured for looking through.

10. An inflatable air mattress tent assembly comprising:

a tent having a pair of sides, the tent having a pair of walls, the pair of sides being positioned perpendicular relative to the pair of walls, a door being positioned on a first wall of the pair of walls, the door having a flap, the flap having hook material the door having loop material the flap engaging by hook and loop fastening to the door, each of the sides having a plurality of supports, the plurality of supports being rectangular bars configured for providing stability to each of the sides, a roof being positioned perpendicular relative to the pair of sides and the pair of walls, the roof having a plurality of cables, the cables being coupled to the plurality of supports, each of the cables being configured for providing structure to the roof, the tent having an interior, the interior defining a space for a variety of elements to be positioned within;

a mattress being positioned within the interior of the tent, the mattress being an air mattress, the mattress being configured for inflation by air, the mattress being in fluid communication with a pump, the pump being positioned on the first wall of the pair of walls, the pump being configured for providing air to inflate the mattress, the mattress being configured for positioning the plurality of supports in a vertical position whereby positioning the pair of sides and the pair of walls in an upright position;

a pillow being positioned on a surface of the mattress, the pillow being positioned proximate to a second wall of the pair of walls, the pillow having a conduit, the conduit being in fluid communication with the mattress, the pillow being configured for inflation;

a window being positioned on the roof of the tent, e window being transparent, the window being a plastic material, the window being configured for looking through; and a screen being positioned on a first side of the pair of sides, the screen being a net material, the net material having a plurality of interwoven rope, the screen having a flap, the flap having the hook material, the screen having the loop material, the flap being configured for engaging by hook and loop fastening to the screen.

* * * * *